US006672533B1

(12) United States Patent
Regebro

(10) Patent No.: US 6,672,533 B1
(45) Date of Patent: Jan. 6, 2004

(54) METHOD AND GUIDANCE SYSTEM FOR GUIDING A MISSILE

(75) Inventor: Christer Regebro, Eskilstuna (SE)

(73) Assignee: Saab AB, Linköping (SE)

( * ) Notice: Subject to any disclaimer, the term of this patent is extended or adjusted under 35 U.S.C. 154(b) by 0 days.

(21) Appl. No.: 10/049,674

(22) PCT Filed: Aug. 9, 2000

(86) PCT No.: PCT/SE00/01557

§ 371 (c)(1),
(2), (4) Date: Apr. 24, 2002

(87) PCT Pub. No.: WO01/14820

PCT Pub. Date: Mar. 1, 2001

(30) Foreign Application Priority Data

Aug. 18, 1999 (SE) ..... 9902924

(51) Int. Cl.[7] ..... F41G 7/00

(52) U.S. Cl. ..... 244/3.13; 244/3.11; 244/3.14; 244/3.15; 244/3.16; 244/3.19

(58) Field of Search ..... 244/3.1, 3.11, 244/3.12, 3.13, 3.14, 3.15–3.22; 89/1.11

(56) References Cited

U.S. PATENT DOCUMENTS

| | | | | |
|---|---|---|---|---|
| 3,233,847 A | | 2/1966 | Grisberger | |
| 3,567,163 A | * | 3/1971 | Kepp et al. | 244/3.14 |
| 3,737,122 A | | 6/1973 | Solov et al. | |
| 3,807,658 A | * | 4/1974 | Miller et al. | 244/3.13 |
| 3,974,984 A | | 8/1976 | Dobson et al. | |
| 3,995,792 A | * | 12/1976 | Otto et al. | 244/3.14 |
| 4,008,869 A | | 2/1977 | Weiss | |
| 4,018,405 A | * | 4/1977 | Baker | 244/3.14 |
| 4,097,007 A | * | 6/1978 | Fagan et al. | 244/3.11 |
| 4,220,296 A | * | 9/1980 | Hesse | 244/3.14 |
| 4,288,049 A | * | 9/1981 | Alpers | 244/3.14 |
| 4,997,144 A | * | 3/1991 | Wolff et al. | 244/3.14 |
| 5,102,064 A | | 4/1992 | Daly | |
| 5,102,065 A | * | 4/1992 | Couderc et al. | 244/3.11 |
| 5,131,602 A | * | 7/1992 | Linick | 244/3.14 |
| 5,647,559 A | * | 7/1997 | Romer et al. | 244/3.13 |
| 5,762,290 A | | 6/1998 | Dupont | |

FOREIGN PATENT DOCUMENTS

| | | |
|---|---|---|
| DE | 2748545 | 5/1978 |
| FR | 2344807 | 10/1977 |
| GB | 2068091 | 8/1981 |
| GB | 2121934 | 1/1984 |
| GB | 2302224 | 1/1997 |

* cited by examiner

*Primary Examiner*—Bernarr E. Gregory
(74) *Attorney, Agent, or Firm*—Swidler Berlin Shereff Friedman, LLP

(57) ABSTRACT

The present invention relates to a method and an arrangement for guiding a missile. In accordance with the prior art, the angle position of a target (9) when the missile (3) is expected to reach the target is predicted on the basis of the angular velocity determined in a preceding time period. In order to improve the strike accuracy, the operator, in a second subsequent time period, tracks the actual position of the missile in relation to the predicted angle position of the target. If a deviation is observed, a correction command is transmitted to the missile in order to correct the missile trajectory. For this purpose, a communications link is provided to transmit the correction command given by the operator.

12 Claims, 3 Drawing Sheets

METHOD AND GUIDANCE SYSTEM FOR GUIDING A MISSILE

FIELD OF THE INVENTION

The present invention relates to a method for guiding a missile fired at a target, where the angular velocity of the target is determined on the basis of the operator tracking the target in a first time period during which at least a first angle position and a second angle position of the target are recorded and the time interval between these, and where, based on the determined angular velocity, the angle position which the target is assumed to have when the missile reaches the target is predicted and the missile is guided continuously in a desired, predicted trajectory towards the assumed angle position as a function of time and missile speed. The invention also relates to a guidance system for guiding a missile, comprising means for determining the angular velocity of the target in a first time period before when the operator is tracking the target, based on the recording of a first angle position and a second angle position and the time interval between these, means for predicting the position of the target when the missile is expected to reach the target, based on the determined angular velocity, and means for predicting the desired trajectory. In this text, the term missile is intended to cover all forms of internally and/or externally guided objects which are fired at a target. An example of a suitable type of missile is an anti-tank missile.

BACKGROUND OF THE INVENTION

The traditional way of getting the payload of a portable anti-tank weapon in position is to fire it in a ballistic trajectory to the target. Problems which arise in doing this include:

Operator variations in sighting and firing.

Difficulties in determining the target distance and speed.

Unknown or difficult atmospheric conditions.

Ballistic spread.

Changes in the target's movements.

Certain of the above difficulties are more important when it is necessary to fire from enclosed areas. The low muzzle velocity considerably reduces the maximum range of the weapon. A modern weapon with demands for increased maximum range must in some way overcome the difficulties indicated above. Some form of guidance of the fired missile during its travel to the target is needed.

It has previously been proposed, for medium distances, to use a guidance method known by the term Predicted Line of Sight (PLOS). PLOS is a purely "fire and forget" system. Before firing, the operator estimates the angular velocity at which the line of sight is turning in the sight towards a moving target. The angular velocity is measured by the missile's speed gyro and an estimator. Based on the estimated angular velocity, the target's position is predicted as a function of time after firing and the missile is guided towards the predicted position of the target. At the same time, the effect of the earth's attraction is eliminated. However, there are a number of error sources which limit the PLOS guidance method and which mean that the predicted position of the target does not always agree with the actual position of the target. Errors of the kind listed below can cause the missile to deviate from the desired point of impact or overfly point.

Error in sighting upon launch at target,

Error in estimating the angular velocity of the line of sight,

Error due to angular velocity having been assumed to the constant,

Error in missile's control loop,

Error caused by incorrect estimation of disturbances from the environment, such as wind, etc., Error caused by inadequacies in missile and sensors.

SUMMARY OF THE INVENTION

Against the background of the above, there is therefore a need to increase the strike accuracy at greater distances which, in this context, can be distances in the range of 300 to 1000 meters, for example.

The object of the present invention is to improve the strike accuracy for PLOS-based guidance methods. The object of the invention is achieved by a method characterized in that the operator, in a second subsequent time period, tracks the actual position of the missile in relation to the predicted angle position of the target so that, if a deviation is observed, a correction command can be transmitted to the missile in order to correct the trajectory predicted for the missile, and also a guidance system which is characterized in that a communications link is provided to transmit any correction commands from the operator to the missile in a second subsequent time period for correction of the trajectory predicted for the missile.

In principle, according to the invention, the missile is driven autonomously after it has been fired. The missile does not need to be continuously fed from the sight with error positions. The firing is preceded by a phase where the angular velocity of the target is determined on the basis of the operator tracking the target in the time period between a first angle position and a second angle position. The tracking can be carried out optically, for example using visible light or IR light.

Since the operator has the possibility of continuously tracking the missile to the target and acting on the missile's trajectory, the operator, if he considers that the missile is not lying within an acceptable distance from the line of sight, can introduce a correction which moves the missile towards the line of sight. The possibility for the operator to track and correct the missile's course means that the errors in the above list can at least partially be compensated. The introduction of the correction during the missile's travel towards the target increases the chances of firing at longer distances and striking rapid and/or manoeuvred targets.

It should be noted here that if the target is stationary, the operator can fire the missile directly at the target. Here again, he has the possibility of correcting deviations in missile trajectories.

According to an advantageous embodiment of the method, the missile trajectory is corrected during the second time period in steps in the direction counter to the observed deviation upon receipt of a correction command activated by the operator. An advantageous embodiment in this connection is characterized in that the correction of the missile trajectory during the second time period in the direction counter to the observed deviation is carried out in one or two steps. A correction in one or two steps is what a qualified operator is considered to be able to do under stress from enemy fire and the forces which are developed during the launch procedure.

According to another advantageous embodiment, an angular velocity of the target estimated in the first time period is corrected in the second time period, the missile trajectory being corrected in proportion to the firing distance, resulting in a stepwise correction in the direction counter to the observed deviation upon receipt of a correction command activated by the operator.

Correction of the missile trajectory is advantageously based on correction commands transmitted by the operator for target distances greater than 300 meters.

An advantageous embodiment of the guidance system according to the invention is characterized in that the communications link on the transmit side is connected to the firing mechanism of the missile via a decoder which, based on correction commands in the form of depressions of the firing mechanism by the operator, identifies the correction commands and, via a transmitter, sends the information to the missile. The guidance system does not require any extra input members on the transmit side of the communications link, and instead the correction commands can be fed via the same trigger which is used for determining angular velocity and for firing. This facilitates the operator's handling of the weapon and means that soon after firing he can track the missile trajectory in order to effect possible correction.

Located on the receive side of the missile, the communications link, in an advantageous embodiment, comprises a receiver for receiving the correction commands and a computer unit connected to the receiver. The computer unit is preferably arranged to use ordinary algorithms to guide the missile in the desired predicted trajectory via a control device incorporated in the missile, preferably with hot gas propulsion via controlled valves or with aerodynamic control surfaces, based on received correction commands and information from the missile's inertia sensors.

In an advantageous embodiment, the communications link of the guidance system operates with laser light.

BRIEF DESCRIPTION OF THE DRAWINGS

The invention will be described in greater detail below by way of example, and with reference to the attached drawings, in which.

DETAILED DESCRIPTION OF THE INVENTION

Figure 1:
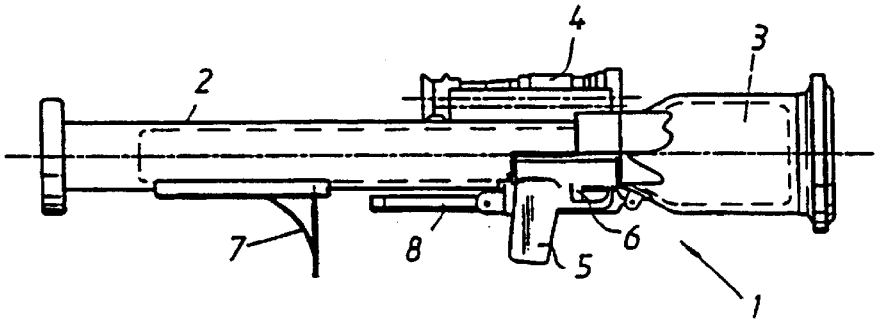
FIG. 1 is a diagrammatic representation of a portable anti-tank weapon provided with a guidance system according to the invention.

The anti-tank weapon 1 shown in FIG. 1 comprises, inter alia, a barrel 2 with a missile part 3 indicated by broken lines. On the barrel there is a sight 4 and a grip 5 with trigger 6. A shoulder support 7 and a pull-out prop 8 can also be seen.

Figure 2:
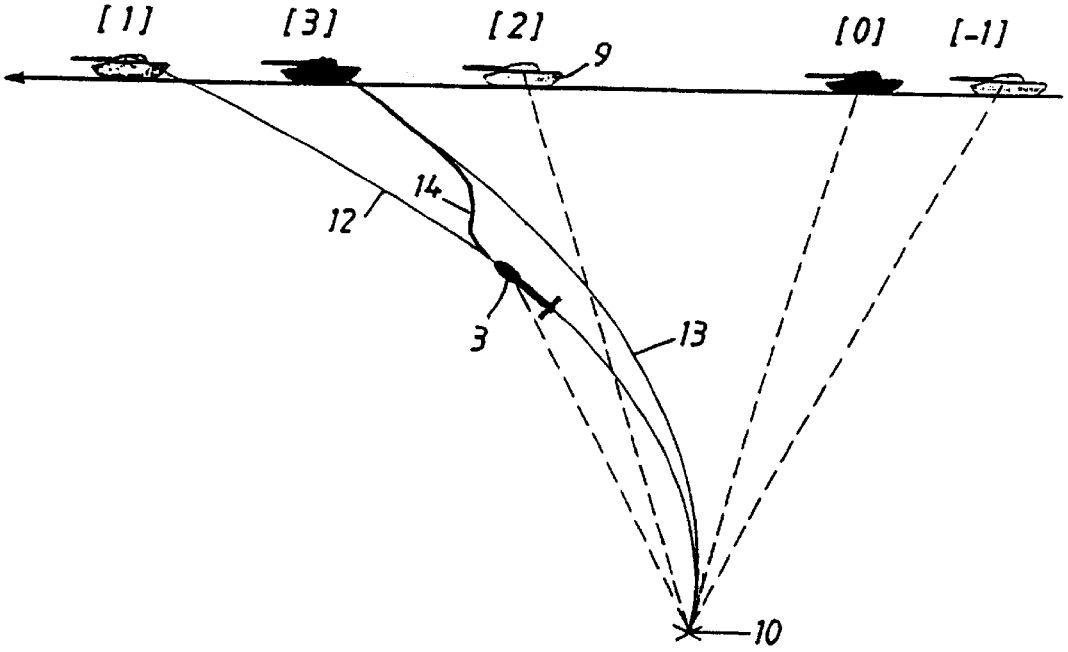
FIG. 2 is a diagrammatic illustration showing a missile being guided towards an enemy tank with correction of the trajectory in accordance with the invention.

Referring to FIG. 2, this illustrates firing at a moving target using the PLOS guidance method, with added operator-controlled correction.

When firing at a moving target 9, here in the form of a tank, the operator 10 tracks the target for several seconds before firing. A yaw and pitch gyro (not shown) in the missile measures the angular velocity of the weapon in order to estimate the angular velocity of the target using an estimator based on Kalman technology. Alternatively, a yaw gyro and a pitch accelerometer can be used for measurement. The guidance is based on the information obtained before firing. A computer unit 21, which will be described in more detail with reference to FIG. 6, calculates the missile trajectory 12. The trajectory is controlled by inertia-controlled sensors described with reference to FIG. 6, control algorithms and control devices with hot gas and controlled valves. To attack the weakest part of the tank, the missile can be guided in a trajectory which lies vertically above the top part of the tank. The tank can then be attacked from above when the missile flies over, so-called Overly Top Attack (OTA). The guidance according to the invention can be applied both for overfly and for direct attack (Impact Mode), and no detailed account of the different modes possible is given here.

When the target is situated at [−1], the operator commences the angle measurement. At point [0], he fires the missile. The estimated angular velocity predicts that the target will be at [1] when the missile reaches or alternatively passes over the target. The missile thus follows a line-of-sight trajectory which ends at point [1]. When the target is at point [2], the operator detects a deviation between the target and the missile. The estimation of the angular velocity was too high or the target has slowed down. The situation indicates that the target will be at point [3] instead of point [1] when the missile passes the target. The missile will be located in front of the target. If the operator tracks the missile's path towards the target, he has the possibility of correcting the course of the missile. A correction command activated by the operator 10 is transmitted to the missile. This makes the missile change course and guides it into a trajectory 13 which ends at point [3]. The trajectory from the correction to point [3] has been designated by 14. Since the error in PLOS mode is very small, this simple correction method is sufficient and it is not comparable to normal CLOS guidance (Command to Line-Of-Sight).

Figure 3A:
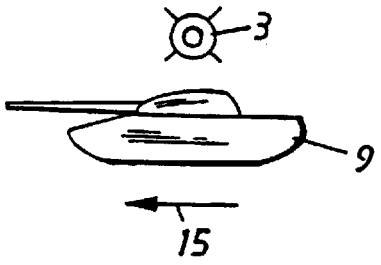
FIGS. 3*a*–3*c* illustrate three different missile positions relative to an enemy tank.
Figure 3B:
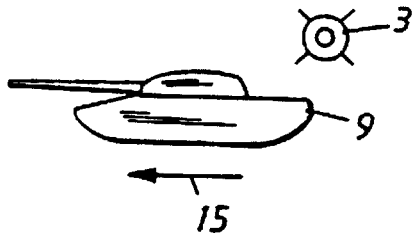
Figure 3C:
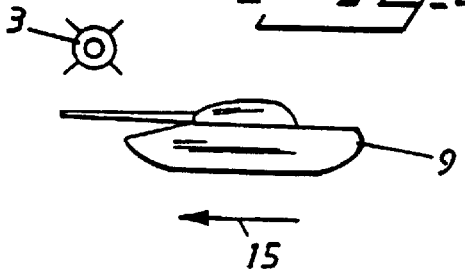

FIGS. 3*a* to 3*c* illustrate three examples of missile positions relative to the target in the form of a tank 9 with direction of travel according to arrow 15. The examples relate to the OTA method. According to the example in FIG. 3*a*, the missile 3 lies right on course for reaching the target. No correction to the course of the missile is needed here. On the contrary, any correction of the course could jeopardize the chances of the missile hitting the tank. According to FIG. 3*b*, the missile 3 is lying on a course which means that the missile will pass behind the tank 9. Here, a course correction is needed in the direction of travel 15 of the tank. According to FIG. 3*c*, the missile 3 lies on a course which means that the missile will pass in front of the tank 9. Here, a course correction is needed in the direction counter to the direction of travel 15 of the tank. A simple means of communicating course corrections to the missile 3 is for the operator 10 to give correction commands in the form of depressions of the firing mechanism. One press can then mean that the missile course is to be corrected in the direction of travel of the target, while two presses means correction in the direction counter to the direction of travel.

Figure 4:
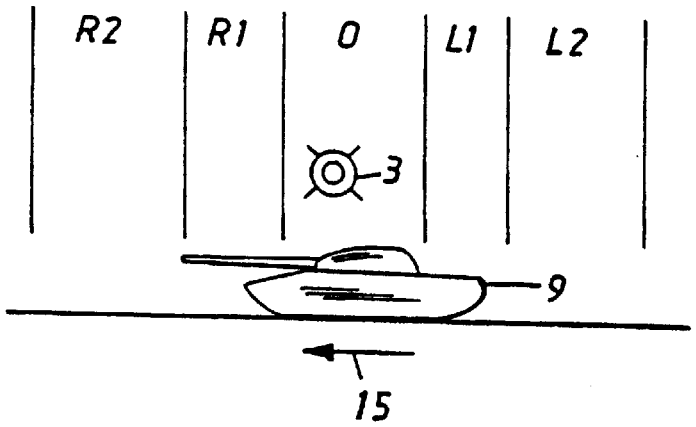
FIG. 4 illustrates correction zones relative to an enemy tank in the case where correction can be done in two steps.

Alternatively, it would be possible to use dual triggers, where one trigger corrects in the direction of travel of the target and the other in the direction counter to the direction of travel. In this alternative embodiment, it is also possible to introduce several correction levels. For instance, one press can define a first correction level and two presses can define a second and greater correction level. FIG. 4 illustrates the situation with two correction levels. If the missile 3 is situated in zones R1 or R2, a correction is required counter to the direction of travel of the target, whereas if the missile is situated in zones L1 or L2, a correction is required in the direction of travel of the target. For correction in zones R1 and L1, which is a small correction, one press is sufficient, whereas for the correction in zones R2 and L2, which is a greater correction, two presses are needed. In zone 0, the missile 3 is on the right course and no correction need be made.

Figure 5:
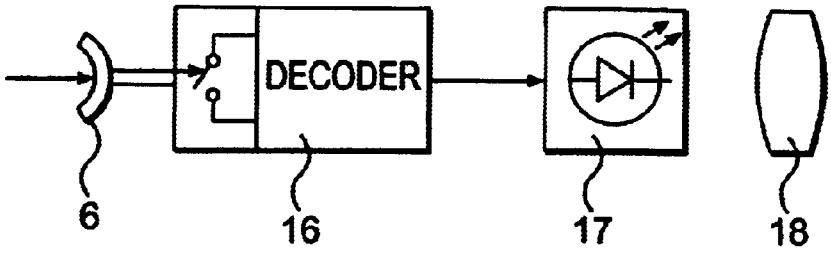
FIG. 5 is a diagrammatic representation of the transmit side of a communications link incorporated in a guidance system according to the invention.

FIG. 5 is a diagrammatic representation of the transmit side of a communications link incorporated in a guidance system according to the invention. The trigger 6 is in this case coupled to a decoder 16 which communicates with a transmitter in the form of a laser diode 17 with optics 18. The decoder 16 identifies the presses made by the operator via the trigger 6 and determines the type of correction. Information on the identified type of correction is transmitted via the transmitter 17 and its optics 18 to the receive side of the communications link.

Figure 6:
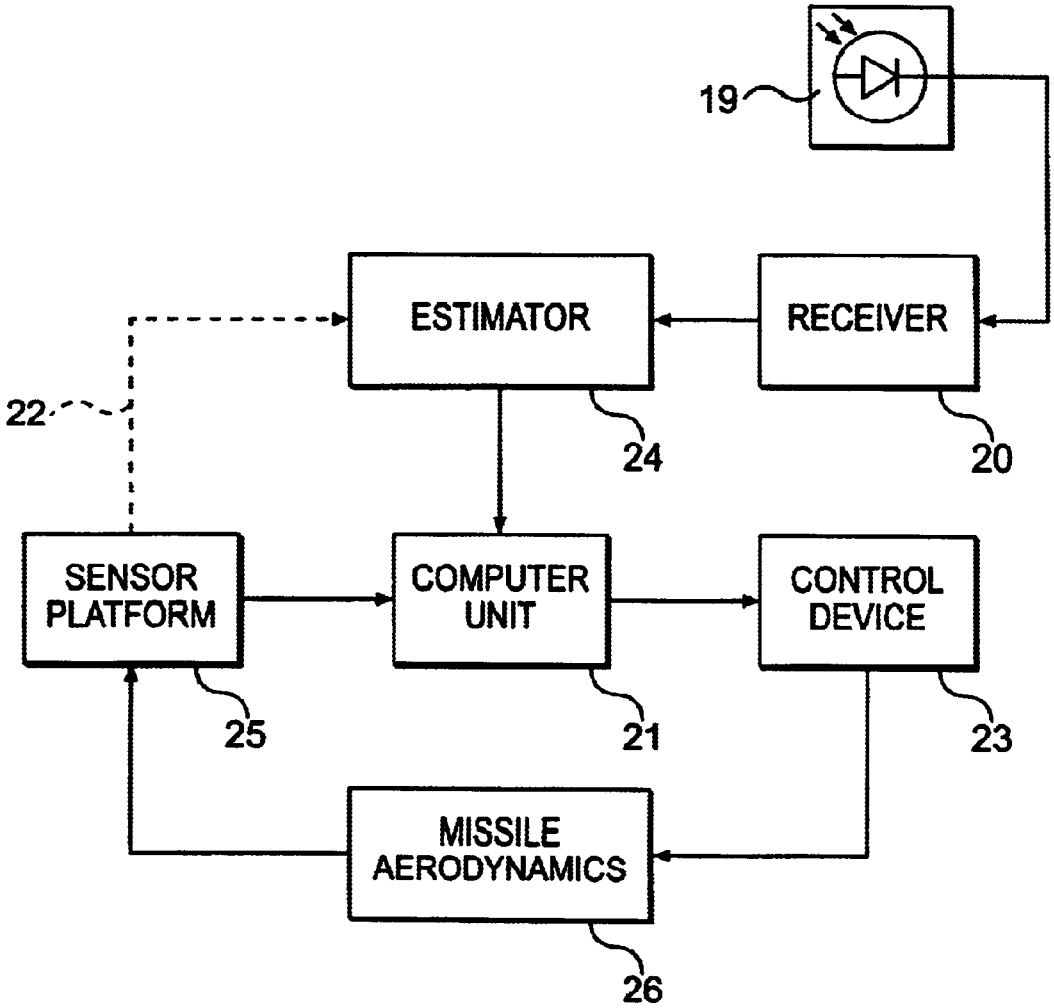
FIG. 6 is a diagrammatic representation of the receive side of a communications link incorporated in a guidance system according to the invention.

Accommodated in the missile at the receive side of the communications link, there is a photodiode 19 which is connected to a receiver 20, as can be seen in FIG. 6. The receiver receives information on the type of correction via the photodiode 19. An estimator 24 estimates the angular velocity of the target based on information supplied before firing by means of the sensor platform 25 of the missile with gyro and accelerometer, and the correction information available. The estimated angular velocity is fed onwards to a computer unit 21 which predicts a desired missile trajectory. The computer unit 21 is in contact with the sensor platform 25 and control device 23 with hot gas and controlled valves or surfaces and controls the control device 23 as a function of information from the receiver 20 and the sensor platform 25 and which has been processed by the estimator 24 and/or the computer unit 21.

The broken line 22 indicates transfer of measurement values before firing. The control device 23 acts on the missile's aerodynamics, as symbolized by the block 26, and a resulting trajectory for the missile is obtained and detected by the sensor platform 25.

The invention is not limited to the above embodiments, and instead a number of alternative embodiments are possible within the scope of the invention as it is defined in the patent claims attached to this description. For example, it is possible to carry out correction in the vertical direction instead of, or in addition to, the sideways direction. By introducing a correction in the vertical direction, the strike accuracy can be considerably improved at long firing distances, for example over 700 meters.

What is claimed is:

1. A method for guiding a missile fired at a target, the method comprising:

tracking the target in a first time period to determine an angular velocity of the target, the tracking including recording at least a first angle position and a second angle position and a time interval between the first angle position and the second angle position;

predicting an assumed angle position that the target is assumed to have when the missile reaches the target based on the determined angular velocity;

continuously guiding the missile in a trajectory towards the assumed angle position as a function of time and missile speed;

tracking an actual position of the missile in relation to a predicted angle position of the target in a second time period; and transmitting a correction command to the missile to correct the trajectory of the missile if a deviation is observed between actual position of the missile and the predicted angle position of the target.

2. The method according to claim 1, wherein upon receipt of the correction command the trajectory of the missile is corrected in steps in a direction counter to the deviation.

3. The method according to claim 2, wherein correction of the trajectory of the missile is carried out in at least one step.

4. The method according to claim 1, wherein a deviation of the determined angular velocity of the target is detected in the second time period, and wherein the trajectory of the missile is corrected stepwise in proportion to a firing distance in a direction counter to the deviation of the target angular velocity upon receipt of a correction command.

5. The method according to claim 1, wherein correction of the trajectory of the missile is carried out for target distances greater than 300 meters.

6. A missile guidance system, comprising:

means for recording a first angle position and a second angle position of a target and a time interval between the recording the first angle position and the second angle position and for determining an angular velocity of a target in the first time interval;

means for predicting a position of the target when the missile is expected to reach the target based on the angular velocity;

means for predicting a desired trajectory of the missile; and a communications link operative to transmit correction commands to the missile in a second time period for correction of the desired trajectory of the missile.

7. The guidance system according to claim 6, wherein the communications link is connected to a firing mechanism of the missile, the system further comprising:

a decoder operative to identify the correction commands based on depressions of the firing mechanism; and a transmitter operative to send the correction commands to the missile.

8. The guidance system according to claim 6, wherein the communications link comprises a receiver operative to receive the correction commands and a computer unit connected to the receiver.

9. The guidance system according to claim 8, wherein the communications link comprises an operator unit operative to use control algorithms to guide the missile in the desired trajectory, the guidance system further comprising:

a control device incorporated in the missile and operative to receive the correction commands and information from inertia sensors of the missile and to control the trajectory.

10. The guidance system according to claim 9, wherein the control device comprises hot gas propulsion via valves.

11. The guidance system according to claim 9, wherein the control device comprises with aerodynamic control surfaces.

12. The guidance system according to claim 6, wherein the communications link operates with amplified coherent light.

* * * * *